United States Patent [19]

Hargett, Sr.

[11] Patent Number: 4,821,667

[45] Date of Patent: Apr. 18, 1989

[54] COMPOSITE FIBERGLASS AND METAL BOAT

[76] Inventor: Dan Hargett, Sr., P.O. Box 51282, Lafayette, La. 70505

[21] Appl. No.: 156,445

[22] Filed: Feb. 16, 1988

[51] Int. Cl.[4] ..... B63B 3/09; B63B 3/16

[52] U.S. Cl. ..... 114/355; 114/356; 114/357

[58] Field of Search ..... 114/355, 356, 357, 85

[56] References Cited

U.S. PATENT DOCUMENTS 3,871,043 3/1975 Davidson et al. ..... 114/356

*Primary Examiner*—Sherman D. Basinger
*Assistant Examiner*—Edwin L. Swinehart
*Attorney, Agent, or Firm*—Pavel, Gambrell, Hewitt, Kimball & Krieger

[57] ABSTRACT

The present invention relates to a novel type of boat construction wherein a metal hull, comprised primarily of aluminum metal and there is fitted thereupon a fiberglass interior supported along the exterior outer edge of the hull, with the interior defining a space for occupants of the boat, and spaced apart from the hull itself at points all except the exterior continuous edge of contact between the hull and the interior fiberglass lining.

11 Claims, 3 Drawing Sheets

COMPOSITE FIBERGLASS AND METAL BOAT

BACKGROUND OF THE INVENTION

1. Field of the Invention

The present invention relates to boats. More particularly, the present invention relates to a composite boat structure including an upper fiberglass shell fixed to a metal hull for defining the interior of the boat.

2. General Background

On the subject of boat construction, most small boats, the type for accommodating boaters or fishermen, known as "Bass" boats, are the type which utilize structure which comprises a hull portion and an interior portion. In most cases, both the hull and interior are constructed of either fiberglass, metal, or for older boats, wood. For such boats, there is in the present state of the art the requirement that the space intermediate the hull and the interior portion of the boat be filled with foam so as to prevent sinkage of the boat should the boat encounter an obstacle and split open during operation.

In addition, there are present in the art, boats which may have a metal hull, and hull accommodating an interior fiberglass lining, of the type disclosed in U.S. Pat. No. 3,871,043, wherein the hull and the liner are formed so that the liner substantially fits the configuration of the hull, and the liner and the hull serve as a composite hull structure.

In addition there is hull construction for boats wherein a rigid inner boxlike structure of steel or aluminum is provided and serves as the main structural element of the hull and is bound to a rigid synthetic foam core which binds to the exterior surface. Also there is provided a layer of fiberglass over the foam for providing a protective outer skin for the hull. This structure is disclosed in the U.S. Pat. No. 4,365,580.

Other patents such as U.S. Pat. Nos. 3,220,027, entitled "Boat Hull Construction"; 2,384,966 entitled "Composite Boat Construction"; 3,559,221 entitled "Hull For A Small Boat"; and 2,312,722 entitled "Metal Boat", all relate to boat construction of smaller types boats and may be pertinent to the present invention.

SUMMARY OF THE PRESENT INVENTION

The present invention relates to a novel type of boat construction wherein a metal hull, comprised primarily of aluminum metal where there is fitted thereupon a fiberglass interior supported upon the hull along the exterior outer edge of the hull, with the fiberglass interior defining a space for occupants of the boat, and spaced apart from the hull itself at all points except the exterior continuous edge of contact between the hull and the interior fiberglass lining.

Therefore, it is an object of the present invention to provide a composite boat structure including an aluminum hull and fiberglass interior attached thereto;

It is a further object of the present invention to provide a composite bass boat structure so that an interior fiberglass portion of the boat is positioned and attached to an exterior metal hull along a common exterior edge joint;

It is still a further object of the present invention to provide a composite bass boat structure with a metal reinforced hull affording a composite fiberglass interior so that placement of the interior onto the hull allows the interior to make contact substantially along a common exterior edge; and It is still a further object of the present invention to provide a composite bass boat having a reinforced metal hull with the ability of the hull to accommodate various configurations of fiberglass interior portions set upon and attached thereto.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE PREFERRED EMBODIMENT

Figure 1:
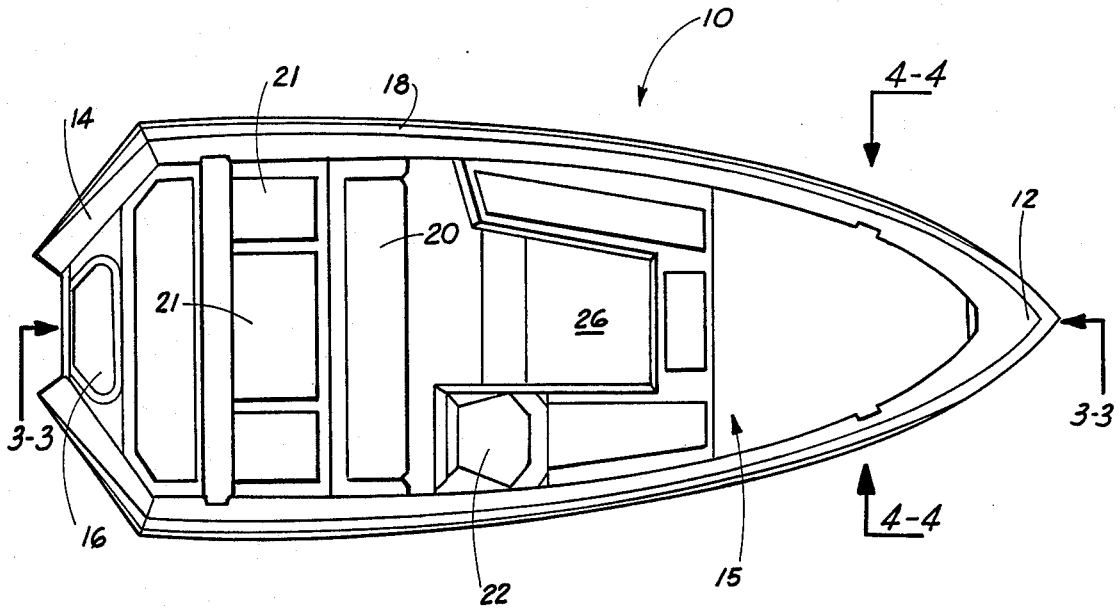
FIG. 1 is a top view of a common bass boat configuration incorporating the present invention.

FIGS. 1 through 5 illustrate the preferred embodiment of the present invention by the numeral 10. For purposes of the present invention boat 10 is illustrated as comprising a typical "Bass" boat of the type utilized to have several fishermen in an open interior, for undertaking outdoor sports fishing. As illustrated in FIG. 1, bass boat 10 would be configured having a front portion 12 and a rear portion 14, the front portion 12 aerodynamically configured for ease of movement through the water, and rear portion 14 including a transom portion 16 for accommodating a typical outboard motor for the type for propelling the boat in the water. As illustrated, boat 10 would comprise a top portion 15, referred to as the boat interior, which includes an outer exterior mounting rim 18, a seat 20, a console 22 for housing the steering wheel and the boat controls, for the operation of the boat. The boat would also include an upper deck 24 and a interior deck 26 for allowing movement around the boat for fishing and the like during use. There is also included a plurality of bait boxes 21 directly to the rear of seat 20 in the preferred embodiment of the boat. For purposes of FIG. 1, as recited earlier, this is a typical bass boat structure which is utilized presently in the art.

Figure 2:
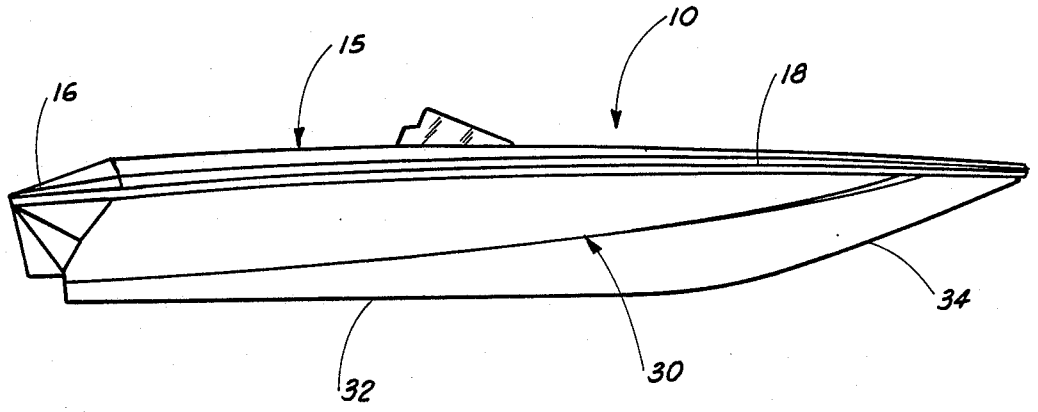
FIG. 2 is a side view of a common bass boat configuration incorporating the present invention.

In FIG. 2 there is illustrated a side view of bass boat 10 illustrating an exterior hull portion 30, having a substantially horizontal underside 32 with a sloping forward rate portion 34 for again cutting through the water as the boat is propelled therethrough. Again there is included in side view transom 16 for mounting a motor thereupon, and the exterior upper edge portion 18 along its perimeter. As illustrated in the Figures, the hull portion 30 would be comprised principally of a lightweight metal such as aluminum or steel, of sufficient thickness to overcome any possible obstacles within the water, and the interior portion 15, which configures the top portion of the boat as seen in FIG. 1 constructed of a fiberglass material so that the boat is constructed of, as seen in FIG. 3, a fiberglass interior 15 attached to the metal hull 30 along mounting rim 18.

Therefore, this composite boat structure, as will be discussed further, incorporates a hull of strength and structural integrity, yet accommodates an interior portion set upon the hull and attached thereto which is lightweight, and can be molded to configure the required portions as illustrated in top view in FIG. 1.

Figure 3:
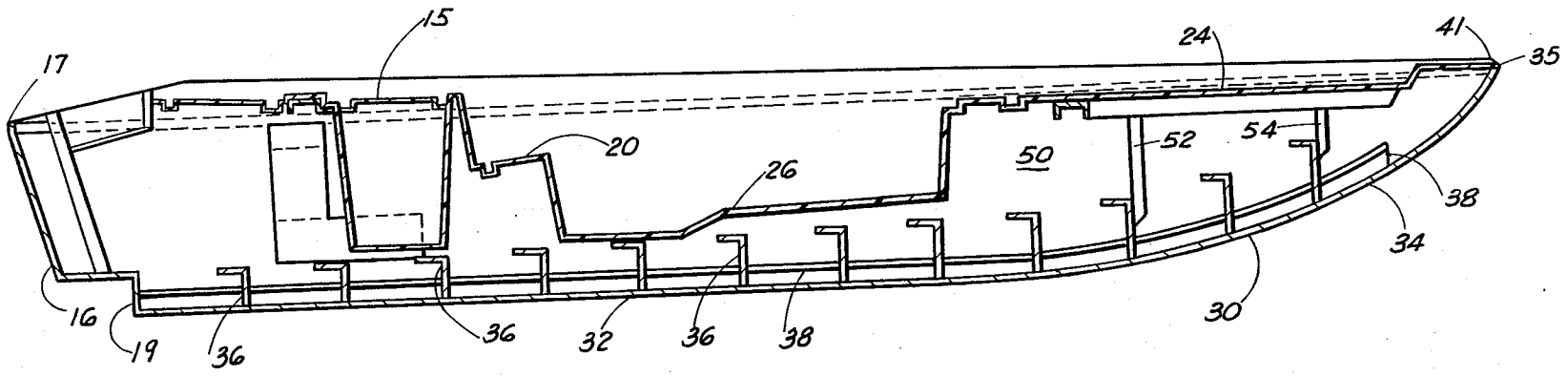
FIG. 3 is a cross-sectional view along lines 3—3 in FIG. 1 which embodies the present invention.

Turning now to FIG. 3, hull 30 as seen in cross-sectional view comprises a composite metal frame 32 extending from the rear transom portion 16 at upper edge 17 to the upward slopping rake portion 34 at upper edge 35 on the front end portion. There is further provided a plurality of interior metal support I beams 36 extending across the width of the hull in transverse configuration, each I beam 36 substantially equally spaced and extending up the rake portion 34 a substantial distance. In addition, there is illustrated a longitudinally positioned beam 38 extending the length of the hull 30 from the rear end portion 19 forward intersecting the plurality of support I beams 36 again up the rake 34 to a distance substantially adjacent the forward end portion of the boat. The combination of the transverse support I beams 36 and the longitudinally positioned beam 38 provide a metal hull having structural integrity to enable the boat to easily move as it is propelled through the water.

Further illustrated in FIG. 3 is the interior lining 15. As seen in the Figures, interior lining 15 includes a forward attachment point 41 which in cross-sectional view attaches at the hull along the common edge 35 and extends rearwardly to configure the shape of the upper deck 24, the lower deck 26, the seat portions 20 and the other components of the interior of the boat for housing the occupants therein. For purposes of structure it should be made clear that the fiberglass interior 15 is supported primarily onto the hull 30 along the common mounting rim 18 so that substantially the interior 15 is positioned a distance apart from the hull 30 and defines an interior space 50 between the hull 30 and the interior lining 15. In addition, for further support there is included a pair of mounting members 52 and 54 which extend interiorly between the hull 30 and the interior 15 for insuring structural integrity between the hull and the upper deck portion 24. In addition at lower deck 26 there is support between the transverse beam 36 and the lower portion of the interior 15 which defines the lower deck for the same purposes of structural integrity. However, for all purposes, interior 15 is substantially mounted on the hull along its exterior perimeter 18.

Figure 4:
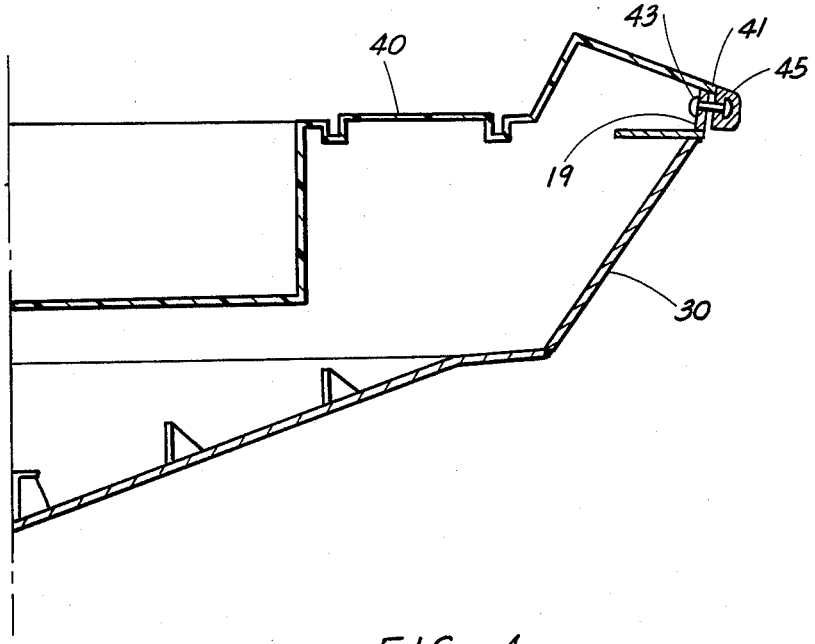
FIG. 4 is a partial cross-sectional view along lines 5—5 in FIG. 1 illustrating attachment between the lower hull and the upper interior portion of the boat.
Figure 5:
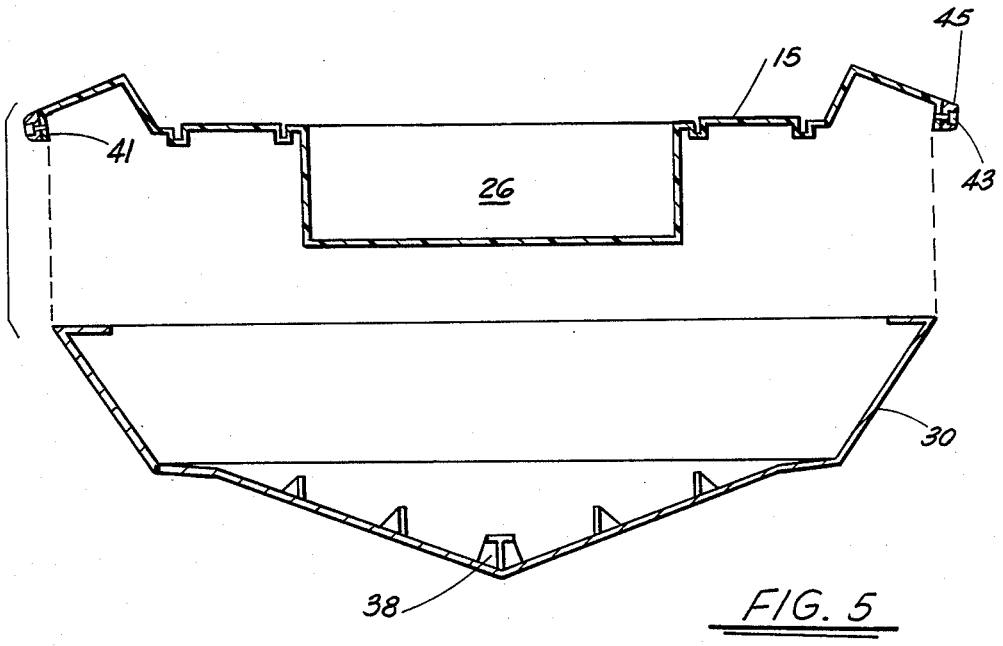
FIG. 5 is a cross-sectional exploded view of the composite metal hull/fiberglass interior composite boat.

FIG. 4 illustrates the mounting means between the hull 30 and the interior lining 15 of the boat 10. As seen in FIG. 4, interior lining 15 includes a downward depending shoulder edge 41 which would substantially overlap around the continuous outer edge 19 of hull 30, and once in position would form a composite joint between hull 30 and boat interior 15. Following the positioning of boat interior 15 onto hull 30, there is provided a plurality of bolt members 43 which are secured to engage the hull 30 with the interior lining of the boat 15 spaced along the edge 18 around the perimeter of the boat, so that the hull is secured to the boat interior. Following the positioning of the bolts 43 to secure the interior 15 onto the hull 30, a continuous exterior flexible material 45 is positioned around the exterior joint so as to shield the mounting bolts 43 and to serve as a protective barrier between the edge of the boat and the obstacles that the boat may encounter during operation. FIG. 5 illustrates in exploded view a cross-sectional view of the hull 30 in relation to the interior 15, so that, as seen in phantom view, the interior 15 again is mounted to the hull only along the exterior perimeter rim 18 and is maintained a distance apart from the hull.

It is through this novel configuration of the metal hull adapted to receive and support a boat interior along a common exterior edge that provides the necessary combination for allowing the boat to be easily maneuverable, lightweight, yet have the structural integrity of a boat in order to be propelled at high speeds thru the water. In addition, it is foreseen that due to the manner in which the fiberglass interior 15 can be molded, the boat may accommodate various configurations of interiors so that the owner of the boat may simply have interior removed and a second or third type of interior set down in its place and in effect receive an entirely "new" boat.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A composite fiberglass and metal boat, comprising:

a. a metal hull portion, the hull portion including a continuous sloping sidewall terminating at an upper perimeter edge;

b. a fiberglass cap portion, positionable onto the hull, and providing a corresponding exterior cap perimeter edge and a lateral surface extending laterally away from the cap perimeter edge along a substantial portion of the metal hull, so that the edge of the hull fits in mating engagement with the perimeter edge of the cap portion to define a longitudinally extending void space between the cap and the metal hull sidewall; and c. attachment means for securing the cap of the boat to the hull portion along the corresponding perimeter edges.

2. The boat in claim 1, wherein the metal hull portion is further constructed of aluminum or other lightweight metal.

3. The boat in claim 1, wherein the attachment means for securing the interior of the boat to the hull further comprises a plurality of bolt members spaced along a common perimeter edge for bolting engaging the interior to the hull portion.

4. The boat in claim 1, further comprising a lightweight foam material filling a portion of the void space defined between the hull sidewall and the cap portion of the boat.

5. A boat, comprising:

a. a lower metallic hull portion, defined by a floor portion, and an upper sloping wall portion, the wall portion ending at an upper peripheral edge around its perimeter;

b. a molded fiberglass upper cap portion, positionable onto the metal hull, so that at least a portion of the fiberglass upper cap portion extends longitudinally and transversely with respect to the metal hull above the upper peripheral edge of the metal hull, and the cap further comprises an exterior lip, for extending over and connecting to the upper peripheral edge of the hull, so that there is defined a partial void space between the upper fiberglass cap portion and the metallic hull portion; and c. attachment means for securing the fiberglass cap portion of the boat to the hull along the perimeter edge, and in spaced apart relation from the hull, to form the composite boat structure.

6. A composite fiberglass and metal boat structure, comprising:

a. a metal hull portion, the hull portion including a continuous side wall, and a floor portion defining the lower section of the boat, and further providing an upper edge around the perimeter of the sidewall portion;

b. a fiberglass cap portion, extending substantially across the hull portion, and supportable along the top edge of the hull portion, a portion of the fiberglass portion extending longitudinally and at an elevation above the level of the upper edge of the hull portion, the fiberglass cap portion and the hull portion forming the composite boat structure; and c. means for securing the cap portion of the boat to the metal hull portion along the perimeter edges.

7. A composite fiberglass and metal boat, comprising:

a. a metal hull portion, the hull portion further comprising a continuous side wall, and a floor portion, the side wall and floor portion defining a lower section of the boat, and further including a plurality of spaced apart support beams reinforcing the hull floor portion, extending between the side walls and upwardly from along the floor portion;

b. a fiberglass cap, positioned and supported by an upper edge of the hull portion, a portion of the fiberglass cap positioned at least the level of or above the upper edge of the hull portion, and a second portion of the fiberglass cap supported upon a portion of the support beams of the hull portion, the fiberglass cap and the hull portion forming the composite boat; and c. means for securing the fiberglass cap to the metal hull portion along the common exterior edge of the hull portion.

8. The boat in claim 7, wherein the plurality of spaced apart support beams are spaced transverse end to end between the sidewalls and the metal hull.

9. The boat in claim 7, wherein the spaced apart support beams are I-beams.

10. The boat in claim 7, wherein the spaced apart support beams are transverse and longitudinal support beams.

11. The boat in claim 7, wherein the hull further comprises a one piece cap of fiberglass with longitudinally extending portions both above and below the perimeter of the metal hull.

* * * * *